US010618681B2

(12) United States Patent
Fioravanti

(10) Patent No.: US 10,618,681 B2
(45) Date of Patent: Apr. 14, 2020

(54) CHANGEOVER DEVICE APPLICABLE ON PACKAGING MACHINES WITH FLEXIBLE WRAPPING MATERIAL

(71) Applicant: PFM IBERICA PACKAGING MACHINERY S.A., Barcelona (ES)

(72) Inventor: Andrea Fioravanti, Barcelona (ES)

(73) Assignee: PFM Iberica Packaging Machinery S.A., Barcelona (ES)

( * ) Notice: Subject to any disclaimer, the term of this patent is extended or adjusted under 35 U.S.C. 154(b) by 221 days.

(21) Appl. No.: 15/550,346

(22) PCT Filed: Feb. 12, 2016

(86) PCT No.: PCT/EP2016/053038
§ 371 (c)(1),
(2) Date: Aug. 10, 2017

(87) PCT Pub. No.: WO2016/134986
PCT Pub. Date: Sep. 1, 2016

(65) Prior Publication Data

US 2018/0029736 A1 Feb. 1, 2018

(30) Foreign Application Priority Data

Feb. 27, 2015 (IT) ..... VR2015A0034

(51) Int. Cl.
*B65B 59/00* (2006.01)
*B65B 65/00* (2006.01)
(Continued)

(52) U.S. Cl.
CPC ..... *B65B 59/001* (2019.05); *B65B 59/00* (2013.01); *B65B 65/00* (2013.01); *B65B 65/003* (2013.01); *B65B 9/06* (2013.01); *B65B 9/08* (2013.01)

(58) Field of Classification Search
CPC .. B65B 9/06; B65B 9/073; B65B 9/08; B65B 9/093; B65B 59/00; B65B 59/001; B65B 65/00; B65B 65/003
(Continued)

(56) References Cited

U.S. PATENT DOCUMENTS 4,554,777 A 11/1985 Denk et al.
4,807,420 A * 2/1989 Barker ..... B65B 9/073 53/550
(Continued)

FOREIGN PATENT DOCUMENTS

DE 202014102117 U1 * 5/2014 ..... B65B 59/00

OTHER PUBLICATIONS

International Search Report for application No. PCT/EP2016/053038 dated Mar. 31, 2016.

*Primary Examiner* — Stephen F. Gerrity
(74) *Attorney, Agent, or Firm* — Workman Nydegger

(57) ABSTRACT

A changeover device for an intermittent packaging machine with wrapping material constituted by a flexible film for successive welding, forming and work operations of envelopes for containing the packed product, comprises a plurality of mobile stations at adjustable interdistances, designed for performing, in succession, operations of welding, forming and processing of the envelopes (including different envelope formats), each of which is constituted by a substantially vertically-arranged frame, slidably positioned on fixed guide rails. The machine is equipped with a changeover device in which each single station is provided with a brake group able to maintain the single station blocked in a predetermined position along all the work line. Moreover, the adjustment of the interdistance between the stations is accomplished by a motorised shuttle which moves by a linear actuator along the processing line. The shuttle can
(Continued)

comprise a sensor, an engaging device, and a brake release device.

11 Claims, 6 Drawing Sheets

(51) Int. Cl.
*B65B 9/08* (2012.01)
*B65B 9/06* (2012.01)

(58) Field of Classification Search
USPC ..... 53/550, 562, 201
See application file for complete search history.

(56) References Cited

U.S. PATENT DOCUMENTS

| | | | | |
|---|---|---|---|---|
| 4,914,895 | A * | 4/1990 | Kuckhermann et al. | B65B 43/465 53/372.7 |
| 4,956,964 | A * | 9/1990 | Jones et al. | B65B 9/087 53/562 |
| 5,950,404 | A | 9/1999 | Meyer et al. | |
| 6,827,678 | B1 | 12/2004 | Kuempel | |
| 8,978,349 | B2 * | 3/2015 | Solano | B65B 43/465 53/562 |
| 2003/0134733 | A1 * | 7/2003 | Thompson | B65B 59/00 493/51 |
| 2013/0152516 | A1 * | 6/2013 | Sammons et al. | B65B 9/087 53/562 |

* cited by examiner

CHANGEOVER DEVICE APPLICABLE ON PACKAGING MACHINES WITH FLEXIBLE WRAPPING MATERIAL

CROSS-REFERENCE TO RELATED APPLICATIONS

The present invention is a 35 U.S.C. $371 U.S. National Stage Application corresponding to PCT Application No. PCT/EP2016/053038, filed on Feb. 12, 2016, which claims priority to Italian Patent Application No. VR2015A000034, filed Feb. 27, 2015. The entire content of each of the aforementioned patent applications is incorporated herein by reference.

TECHNICAL FIELD

This invention relates to a changeover device applicable to packaging machines with intermittent feed with flexible wrapping material for the operations, in succession, for welding, forming and working envelopes designed for containing the packaged product.

The device according to this invention applies mainly, even if not exclusively, to HFFS (horizontal form fill seal) packaging machines which process various loose food products, such as grated cheese, mozzarella pearls, dog pellets, pasta or other products, which are loaded vertically.

According to the invention the system allows the control and the management of the relative and absolute positioning of the various stations along a working line on which they have freedom of movement by means of recirculating ball screw runners.

The device which determines the variation in the spacing of the envelopes acts simultaneously on the cutting and welding groups positioned on suitable sliding rails positioned on longitudinal supporting members.

The invention applies in the mechanical engineering industry applied to packaging machines, in particular to automatic packaging machines in food product lines.

BACKGROUND ART

Use is known in the packaging sector of packaging machines which form part of a system which is able to automatically place products, such as food products but also other products, in envelopes and boxes, using automatic packaging lines.

The products to be packaged are automatically sent towards packaging lines which use horizontal or vertical packaging machines, of the flow-pack and HFFS type (horizontal form fill seal), which make closed packs, generally with three seals, of various products mainly loose, such as grated cheese, mozzarella pearls, dog pellets and pasta, with vertical loading, starting from a reel of hot or cold sealing wrapping material consisting of a flexible film.

The packaging machines may in general also be very different from each other, but all have in common the aim of placing the product in envelopes, starting from a reel of heat-sealing wrapping material, and conveying it towards the boxing sector.

One of the problems encountered with the use of these packaging machines regards the possibility of having to package batches of products of different size which can be placed in packages having differing dimensions from one size to the other.

This possibility, which is also very common especially in the case of various loose products such as grated cheese, mozzarella pearls, dog pellets and pasta, which are loaded vertically, results in some practical difficulties, during the steps for changing the format of the envelopes, as on one hand it is necessary to use skilled personnel working manually and even with lengthy process times, and on the other hand there is a certain degree of imprecision in the setting up of the formats.

In effect, traditional packaging machines, especially those with a high productivity, are equipped with a plurality of the forming, welding, cutting and pulling groups, which, in the event of change of size of the envelope used for the packaging, due, precisely, to the change of size of the product to be packaged, must be moved one at a time to change from the dimensions of the previous format to that necessary for to the subsequent working.

In some cases, certain automatic devices are used with the aim of mechanising the changeover process, however their efficiency has been found to be rather limited and poor, and not able to guarantee the necessary precision.

Currently, in effect, some manufacturers install, for example, a system with a relatively simple design for movement of the various stations and only for a limited number of stations, typically those for welding.

The system for movement of the stations which is used in some cases connects the movable stations with a single "drive unit", for example a threaded bar, which moves them simultaneously so as to modify the spacing.

A problem found using this solution is the fact that the movement is only relative between one station and the other and it is not possible to move a single station.

This represents a significant limitation since small adjustments on the individual stations are not allowed in order to correct the inevitable imprecisions of the packaging machines.

A further problem found is that relative to the limited effectiveness, since this type of semi-automatic adjustment is applicable to a limited number of stations since they must be interconnected by the drive unit.

DESCRIPTION OF THE INVENTION

The aim of this invention is to provide a changeover device, applicable to intermittent advancement packaging machines with wrapping material constituted by a flexible film, which allows the control and management of the relative and absolute positioning of the various stations along a working line on which they have freedom of movement, for example, by means of recirculating ball screw runners, thereby creating a condition which is able to eliminate or at least drastically reduce the above-mentioned drawbacks.

The invention also aims to provide a changeover device which is able to operate automatically on the adjustment of all the stations in very quick succession, making this operation extremely simple, fast and precise.

This is achieved by means of a changeover device applicable to the intermittent packaging machines with flexible wrapping material, the features of which are described in the main claim.

The dependent claims of the solution according to this invention describe advantageous embodiments of the invention.

The main advantages of this solution relate to the fact that, on the one hand, this device allows the format of envelopes of packaging machines to be changed in a fully automatic fashion, referring simply to a set of instructions stored on the control panel, without mechanical intervention by the operator, and, on the other hand, also allows micro-adjustments of the position of the stations, if necessary, thanks to the accuracy and repeatability of the movement.

DESCRIPTION OF THE DRAWINGS

Other features and advantages of the invention will become clear on reading the description given below of one embodiment, provided as a non-limiting example, with the help of the accompanying drawings, in which.

DESCRIPTION OF AN EMBODIMENT OF THE INVENTION

With reference to the accompanying drawings, the numeral 10 denotes in its entirety a packaging machine of the "HFFS" type (horizontal form fill seal), that is an automatic packaging machine which uses a single reel of film for the packaging by applying three seals, two lateral and one horizontal, which can be used mainly, although not exclusively, in the food sector.

More specifically, the packaging machine 10 is designed to perform consecutive and automatic packaging of the product using flexible wrapping material, and therefore comprises a series of movable stations, labelled 11, designed to perform operations, in succession, for welding, forming and working envelopes even of a different size.

According to the invention the system allows the control and the management of the relative and absolute positioning of the various stations 11 movable along a working line on which they have freedom of movement by means of recirculating ball screw runners.

Figure 1:
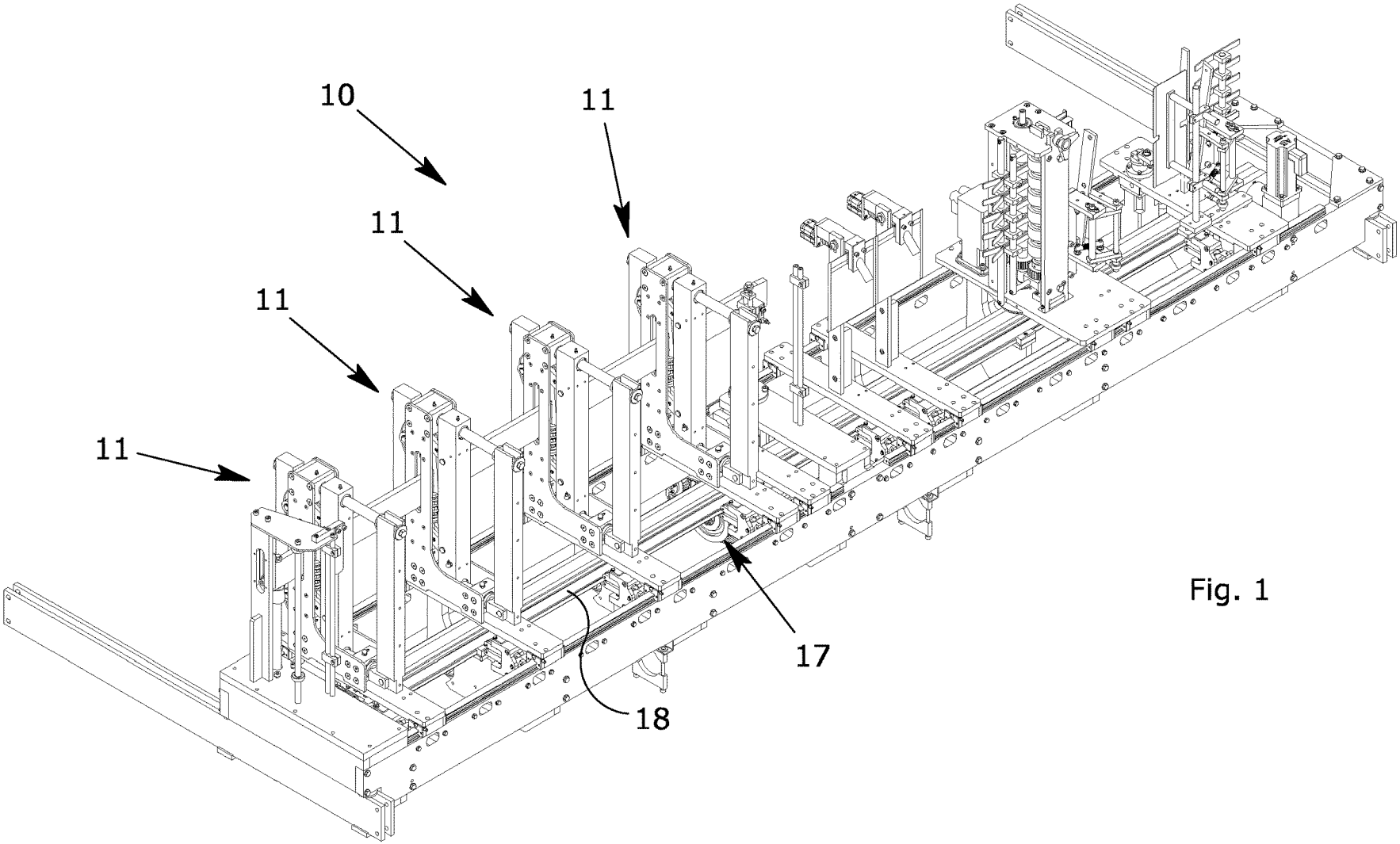
FIG. 1 is a schematic view of a packaging machine with intermittent movement according to the invention of the type with flexible wrapping material.
Figure 2:
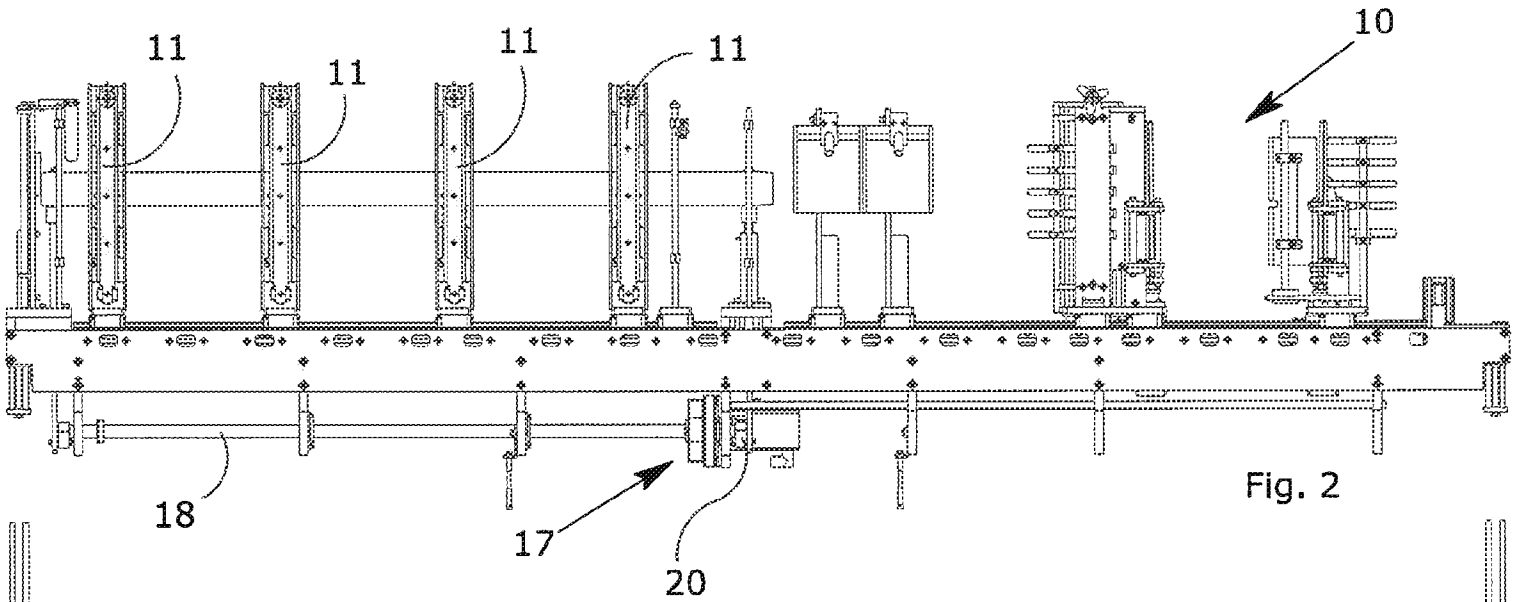
FIG. 2 is a schematic side view of the packaging machine with intermittent movement of the type with flexible wrapping material of the previous figure.
Figure 3:
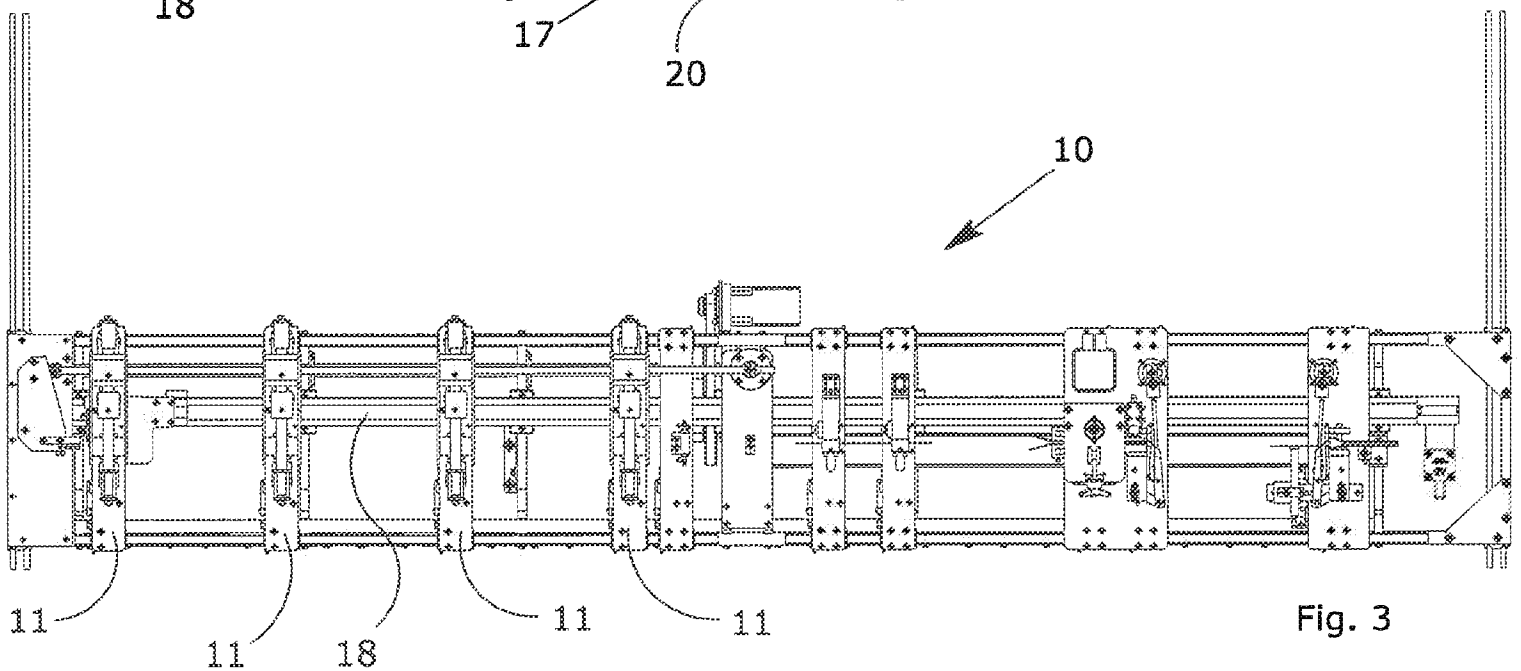
FIG. 3 is a schematic top view of the packaging machine with intermittent movement in the preceding figures.
Figure 4:
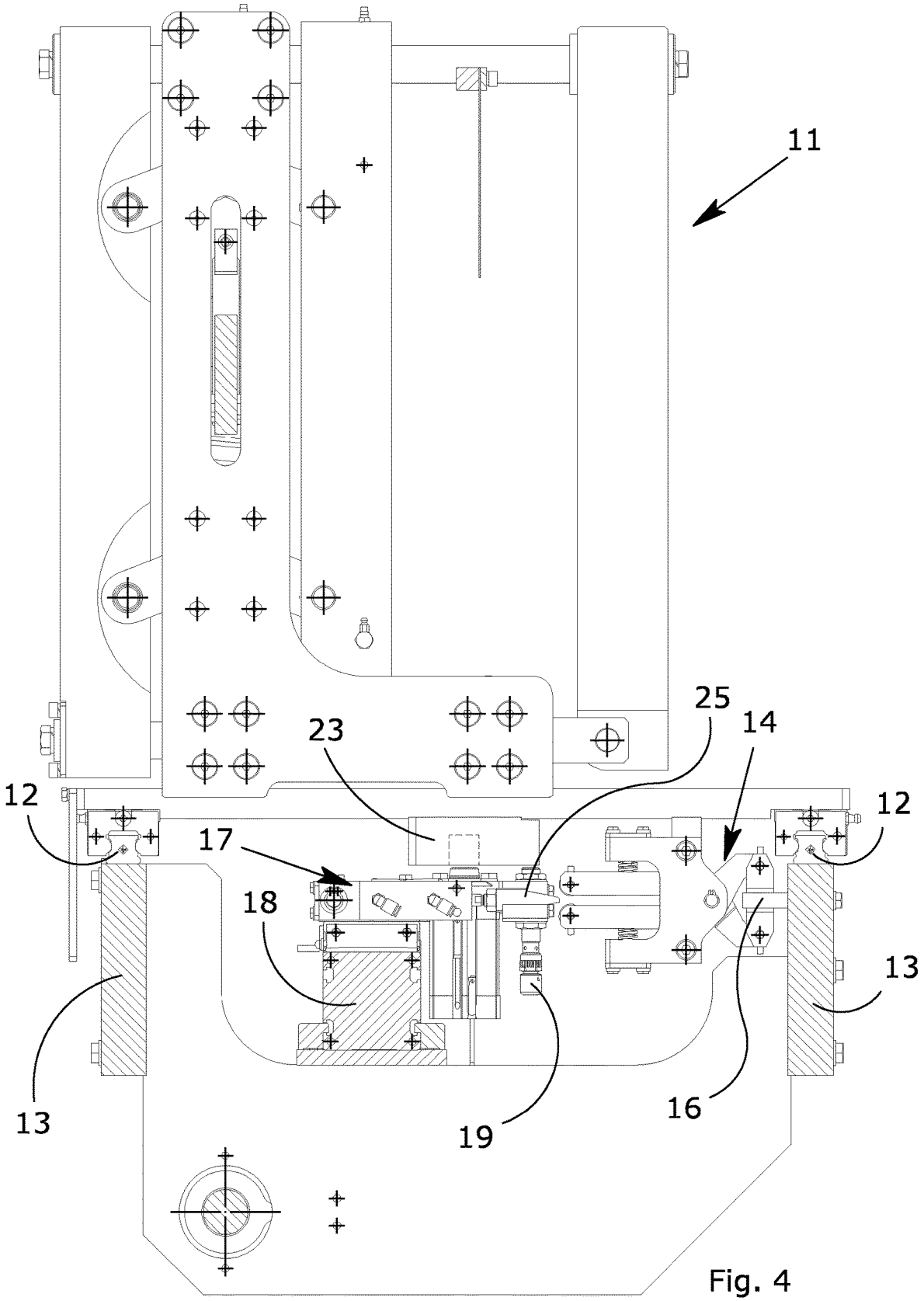
FIG. 4 is a front view of one of the various stations along a working line on which they have freedom of movement by means of recirculating ball screw runners.
Figure 5:
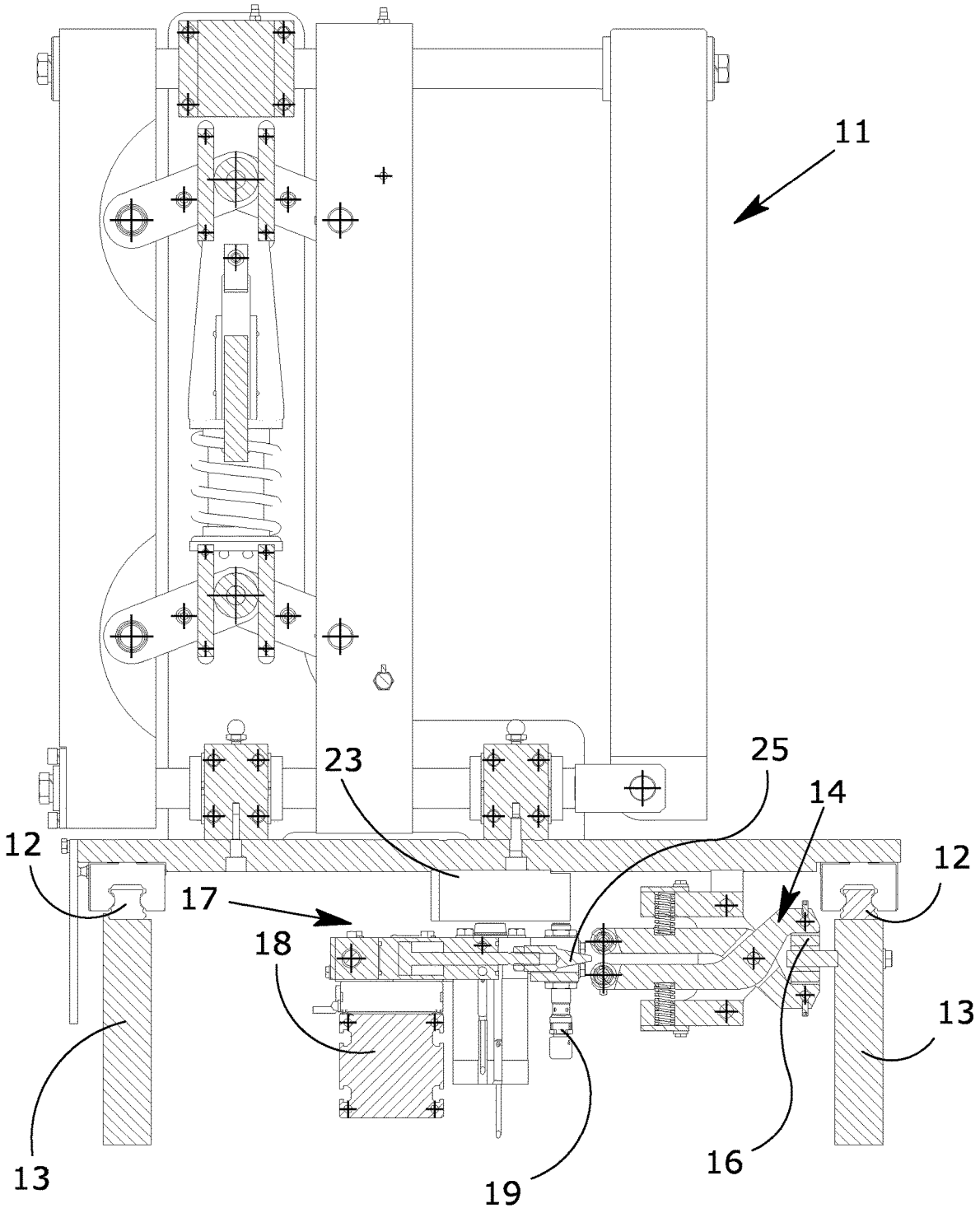
FIG. 5 is another front view of one of the various stations represented on a different vertical cross-section plane.

More specifically (see in particular FIG. 4), each of the stations 11, which represent the groups which can be adjusted depending on the size of the envelope, consists of a substantially vertical frame, positioned, with the possibility of sliding on recirculating ball screw runners, on guide rails 12, in turn positioned on horizontal supporting transversal members 13.

Figure 7:
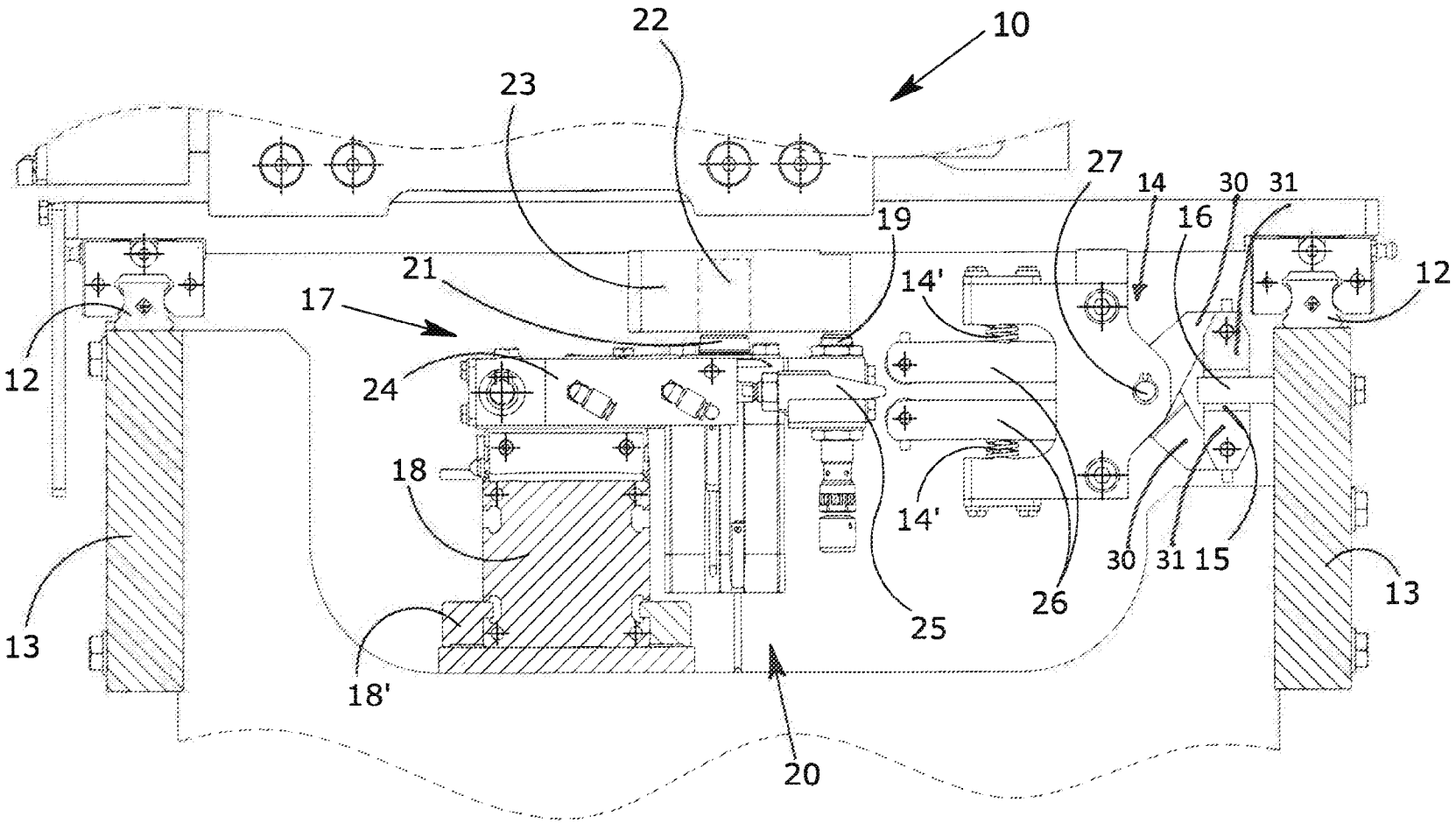
FIG. 7 shows a detail of the lock and release unit of the sliding carriage of each of the stations.

As illustrated in FIG. 7, each single station 11 is equipped with a brake group 14 with independent pliers and normally braked in opposition to springs 14', whose pads 15 act on a bar 16 fixed to the frame common for all the stations and which extends along all the work line.

According to the invention the movement of the stations is achieved through a motorised shuttle 17 which moves on a linear actuator 18 along the working line.

The shuttle 17 is equipped with a sensor 19 for recognising the individual station 11 and a relative position thereof, a device 20, constituted by a pneumatic wedge-shaped cylinder, designed to release the brake 14 and a device for engaging the station for moving it.

Figure 6:
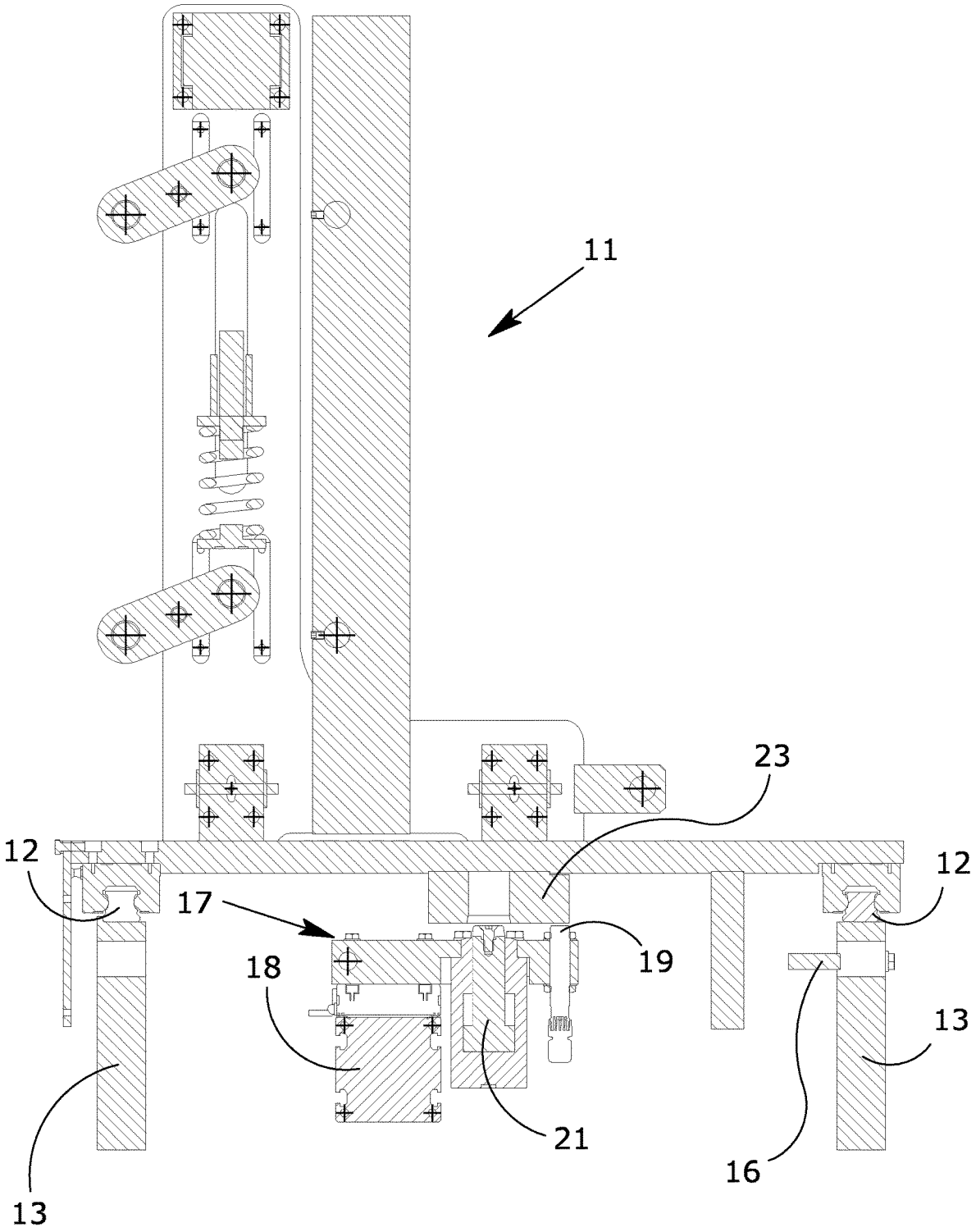
FIG. 6 is a further front view of one of the stations represented on a different vertical cross-section plane.

More in detail, the shuttle 17 which runs along the work guide 18' and which is moved by the linear actuator 18, comprises (FIG. 6) an engaging device constituted by a cursor 21 having a shaft mobile on a vertical axis which intercepts and inserts in a respective seating 22 (FIG. 7) present in a shoe 23 present in the lower part of each station 11 when the sensor 19 has detected a presence and the position.

The same shuttle 17 also comprises a pneumatic cylinder 24, which moves on a horizontal axis a wedge 25 designed to spread two levers 26 forming part of the pliers 30 hinged on the pin 27.

From an operational point of view, when the shuttle 17 has positioned below the station 11 to be moved the sensor 19 controls the stopping at the shoe 23 allowing actuation of two simultaneous events:

a) vertical introduction of the cursor 21 in the seating 22 which constrains the shuttle to the station when the sensor 19 detects correct alignment thereof;

b) the simultaneous introduction horizontally of the wedge 25 between the two levers 26, which, on spreading, enable opening of the jaws 31 which deconstrain from the bar 16, freeing the brake of the station 11, enabling displacement thereof by means of the same shuttle that has deconstrained it.

The system is managed by a software interface which allows the position of the various stations to be defined in a very simple manner.

The operation sequence is such that firstly the operator defines on the control panel the positions of the stations or directly the size of the envelope to be made or refers to a combination previously stored.

The device then performs a reading sequence to check the actual position of the stations 11, making it possible to compensate for any accidental movements, and then moves one station at a time.

The shuttle 17 is positioned exactly beneath the station 11 to be moved, activates the station attachment device, consisting of the cursor 21, and the brake release device, consisting of the wedge 25 for opening of the jaws.

The shuttle imparts the programmed movement to the station 11 moving it by the extent necessary to the requested position (with an approximate degree of accuracy which can be assumed to be about 0.5 mm) and then re-engages the brake and releases the station, proceeding to the movement of the other stations.

The system makes it possible to move one station at a time but with the advantage of having a single smart shuttle which makes it possible to adjust all the stations in succession and fully automatically, with a clear reduction in the length of adjustment times and with an excellent precision.

The operation occurs with the machine stopped, since it is not possible to move a station whilst it is working.

This device allows the operations to be performed for changing the format of envelopes of packaging machines in a fully automatic fashion, referring simply to a recipe stored on the control panels, without having to request mechanical operations by the operator.

This also allows micro-adjustments to the position of the stations to be performed, if necessary, thanks to the accuracy and the repeatability of the movement.

The invention as described above refers to a preferred embodiment. It is nevertheless clear that the invention is susceptible to numerous variations which lie within the scope of its disclosure, in the framework of technical equivalents.

The invention claimed is:

1. A changeover device for an intermittent packaging machine with wrapping material constituted by a flexible film for successive welding, forming and work operations of envelopes for containing a packed product, the changeover device comprising:

a plurality of mobile stations at adjustable interdistances;

wherein each mobile station is configured for performing, in succession, operations of welding, forming and processing of the envelopes, even where the envelopes are of different formats;

wherein each mobile station further comprises:

a substantially vertically-arranged frame, slidably positioned on fixed guide rails; and a brake group configured to maintain the mobile station blocked in a predetermined position along a work line;

a motorized shuttle configured to adjust interdistances between the mobile stations, a linear actuator configured to move the motorized shuttle along the work line, wherein the motorized shuttle further comprises:

a sensor connected to a software control program for recognizing each of the mobile stations and a relative position of each of the mobile stations, an engaging device configured to move the mobile stations during adjustment of the interdistances, and a brake release device for disengaging the brake group so as to enable translation of each of the mobile stations and return each of the mobile stations into the blocked position once adjustment is complete.

2. The changeover device according to claim 1, wherein:

the brake group comprises independent pliers hinged on a pin and a pair of pads activated in opposition to springs; and the pads act on a bar fixed to a frame common for all the mobile stations which extend along the work line.

3. The changeover device according to claim 2, wherein the motorized shuttle runs along a work guide and is moved by the linear actuator, wherein the engaging device is constituted by a cursor having a shaft mobile on a vertical axis which intercepts and inserts in a respective seating present in a shoe positioned in the lower part of each mobile station when the sensor has detected a presence thereof and a position is aligned.

4. The changeover device according to claim 3, wherein the motorized shuttle comprises:

a brake release device for releasing each of the mobile stations, wherein the brake release device is constituted by a pneumatic cylinder, which moves a wedge on a horizontal axis for spreading two levers which are a part of the pliers hinged on the pin.

5. The changeover device according to claim 4, wherein:

the sensor enables the motorized shuttle to seek and trace each of the mobile stations to be adjusted, and thereafter determines a halting of the motorized shuttle at the shoe, wherein halting of the motorized shuttle causes actuation of two simultaneous events comprising:

(i) introduction of the cursor in the seating which constrains the motorized shuttle to the mobile station when the sensor detects correct alignment thereof; and (ii) introduction horizontally of the wedge between the two levers, which, on spreading, enables opening of the pliers which deconstrain from the bar, freeing the brake group of the mobile station, enabling displacement thereof by means of the same motorized shuttle that has deconstrained the mobile station.

6. A changeover device for an intermittent packaging machine with wrapping material constituted by a flexible film for successive welding, forming and work operations of envelopes for containing a packed product, the changeover device comprising:

a plurality of mobile units placed at adjustable interdistances, wherein each mobile unit is configured to perform in succession, operations of welding, forming and processing of the envelopes, even where the envelopes are of different formats;

wherein each mobile unit comprises:

a substantially vertically-arranged frame, slidably positioned on fixed guide rails; and a brake for keeping said mobile unit blocked in a predetermined position along a working line, a motorized shuttle moved by a linear actuator along the working line, the motorized shuttle configured to adjust the interdistances between the mobile units;

wherein the motorized shuttle further comprises:

a sensor connected to a software control program for identifying each of the mobile units and a relative position of each of the mobile units;

a device for engaging and moving the mobile units during adjustment of the interdistances; and a brake release device for disengaging the brake so as to enable translation of each of the mobile units and return each of the mobile units into a blocked position once adjustment of the interdistances is complete.

7. The changeover device of claim 6, wherein:

the brake comprises independent pliers hinged on a pin and a pair of pads activated in opposition to springs; and the pads act on a bar fixed to a frame common for all the mobile units which extend along the working line.

8. The changeover device of claim 7, wherein the brake release device comprises:

a pneumatic cylinder for moving a wedge along a horizontal axis, thereby spreading apart two levers which are a part of the pliers hinged on the pin.

9. The changeover device of claim 8, wherein the software control program is further configured to introduce the wedge between the two levers, which, on spreading apart from each other, move the pads away from the bar, releases the brake of the mobile unit and allowing the motorized shuttle to displace said mobile unit.

10. The changeover device of claim 6, wherein the device for engaging and moving the mobile units during adjustment of the interdistances comprises:

a cursor having a shaft mobile on a vertical axis that is inserted in a seating made in a shoe positioned in the lower part of each mobile unit when the sensor has detected a presence thereof and the positions of the shaft and of the seating are aligned to each other.

11. The changeover device of claim 10, wherein the sensor and the software control program are configured to:

enable the motorized shuttle to seek and trace each of the mobile units to be adjusted;

to subsequently stop the motorized shuttle at the shoe; and to introduce the shaft of the cursor into the seating, thereby clamping the shuttle to the mobile unit.

* * * * *